US008571815B2

(12) United States Patent
Bar-David et al.

(10) Patent No.: US 8,571,815 B2
(45) Date of Patent: Oct. 29, 2013

(54) SYSTEM AND METHOD FOR AUTOMATED GUN SHOT MEASURING

(75) Inventors: Asaf Bar-David, Harchava Dromit (IL); Yuval Spector, Kfar Monash (IL)

(73) Assignee: Secubit Ltd., Harchava Dromit (IL)

( * ) Notice: Subject to any disclaimer, the term of this patent is extended or adjusted under 35 U.S.C. 154(b) by 445 days.

(21) Appl. No.: 13/008,103

(22) Filed: Jan. 18, 2011

(65) Prior Publication Data

US 2011/0178729 A1 Jul. 21, 2011

Related U.S. Application Data

(60) Provisional application No. 61/295,772, filed on Jan. 18, 2010.

(51) Int. Cl.

| | |
|---|---|
| ***G01D 9/00*** | (2006.01) |
| ***G01L 5/00*** | (2006.01) |
| ***G06F 1/32*** | (2006.01) |
| ***G06F 17/40*** | (2006.01) |

(52) U.S. Cl.

USPC ..... 702/41; 73/167; 702/187; 702/189

(58) Field of Classification Search

USPC ..... 73/12.01, 35.14, 167, 570, 865.8; 235/400; 340/500, 540, 665, 870.01, 340/870.07, 870.16; 377/1, 13, 19; 702/1, 702/33, 41, 42, 56, 127, 187, 189; 708/100, 708/105, 200; 713/300, 320, 324

IPC ..... F41A 19/00,19/01; G01D 5/00, 5/12, G01D 9/00, 9/005, 15/00, 15/06, 21/00; G01H 9/00, 17/00; G01L 1/00, 1/16, 1/18, 5/00, G01L 5/0052, 5/14; G06F 1/00, 1/26, 1/32, G06F 1/3203, 1/3234, 11/00, 11/30, 11/32, G06F 17/00, 17/40, 19/00

See application file for complete search history.

(56) References Cited

U.S. PATENT DOCUMENTS

| | | | | |
|---|---|---|---|---|
| 2,427,901 | A * | 9/1947 | Clark | 273/373 |
| 5,303,495 | A | 4/1994 | Harthcock | |
| 6,047,380 | A * | 4/2000 | Nolan et al. | 713/324 |
| 6,255,962 | B1 * | 7/2001 | Tanenhaus et al. | 340/870.05 |
| 6,400,647 | B1 * | 6/2002 | Huntress | 367/136 |
| 6,469,639 | B2 * | 10/2002 | Tanenhaus et al. | 340/870.16 |

(Continued)

OTHER PUBLICATIONS

International Search Report and Written Opinion received in PCT Appln. No. PCT/IL2011/050212, dated Jun. 21, 2011.

(Continued)

*Primary Examiner* — Edward Cosimano

(74) *Attorney, Agent, or Firm* — The Law Office of Michael E. Kondoudis

(57) ABSTRACT

A system, device and method are provided to enable low energy firearm shot measurement, including, in some embodiments, an impact sensor adapted to detect a substantial impact event from the firearm, and to generate an analog signal representing the impact event; an electronic circuit supporting a microprocessor to enable processing of digital data representing the analog signal, the electronic circuit also supporting a memory unit to store the data, the microprocessor and the memory being designed to be substantially in a sleep state except for a selected time interval related to the impact event following an identification of the impact event from the firearm; an amplifier, adapted to amplify the analog signals and transmit the signals to the circuit; a power source to support the circuit supported components; and a communications module for enabling communicating of the digital data to an external data receiver, upon demand.

20 Claims, 4 Drawing Sheets

(56) References Cited

U.S. PATENT DOCUMENTS

| | | | | |
|---|---|---|---|---|
| 6,895,347 | B2 * | 5/2005 | Dorny et al. | 702/63 |
| 7,117,107 | B2 * | 10/2006 | Dorny et al. | 702/63 |
| 8,191,421 | B2 * | 6/2012 | Petelenz et al. | 73/579 |
| 2002/0011937 | A1 * | 1/2002 | Tanenhaus et al. | 340/870.05 |
| 2002/0067661 | A1 * | 6/2002 | Huntress | 367/136 |
| 2003/0061753 | A1 | 4/2003 | Glock | |
| 2004/0073388 | A1 * | 4/2004 | Dorny et al. | 702/63 |
| 2005/0144355 | A1 * | 6/2005 | Dorny et al. | 711/101 |
| 2005/0144356 | A1 * | 6/2005 | Dorny et al. | 711/101 |
| 2005/0149663 | A1 * | 7/2005 | Dorny et al. | 711/101 |
| 2007/0109064 | A1 | 5/2007 | Micko | |
| 2008/0016744 | A1 | 1/2008 | Joannes et al. | |
| 2008/0039962 | A1 | 2/2008 | McRae | |
| 2010/0326192 | A1 * | 12/2010 | Petelenz et al. | 73/579 |

OTHER PUBLICATIONS

International Preliminary Report on Patentability received in PCT Appln. No. PCT/IL2011/050212, dated Jul. 24, 2012.

* cited by examiner

SYSTEM AND METHOD FOR AUTOMATED GUN SHOT MEASURING

CROSS REFERENCE TO RELATED APPLICATIONS

This application claims priority from expired US Provisional Patent Application No. 61/295,772, filed 18-JAN-2010, entitled "SYSTEM AND METHOD FOR AUTOMATED GUN SHOT MEASURING", which is incorporated in its entirety herein by reference.

FIELD OF THE INVENTION

This invention relates generally to the field of weapon usage monitoring. More particularly, embodiments of the invention relate to systems, methods and devices useful in providing enhanced gun shot measurement.

BACKGROUND OF THE INVENTION

Many devices have been proposed to monitor the number of rounds or shots fired from automatic or semi-automatic weapons. Many of the known devices, however, are significant energy consumers, therefore creating significant longevity limitations.

For example, numerous shot counter devices and systems have been described that include accelerator sensors, acoustic sensors, impact wave sensors, or other energy consuming sensors that in general must be continually powered in order to operate. So too, many known shot counter devices include data transmitting units that must likewise be powered to enable effective data transmission to external data receivers. Additionally, many known devices include integrated circuits with controllers etc. which also requiring continual powering to maintain operations. Furthermore, many more complex shot counter devices include display screens for data viewing, which are typically significant energy consumers. In the above cases, the energy requirements may require larger power sources, adding to the size and/or mass of the devices, as well as the longevity of usage before recharging or power source replacement is required.

It would be advantageous to have a weapon usage monitoring device or system that has a substantially low energy requirement, so as to enable effective usage over extended time periods.

SUMMARY OF THE INVENTION

There is provided, in accordance with an embodiment of the present invention, an apparatus, system, and method for enabling energy efficient automated gun shot counting.

According to some embodiments, a system, device and method are provided to enable low energy firearm shot measurement, including, in some embodiments, an impact sensor adapted to detect a substantial impact event from the firearm, and to generate an analog signal representing the impact event; an electronic circuit supporting a microprocessor to enable processing of digital data representing the analog signal, the electronic circuit also supporting a memory unit to store the data, the microprocessor and the memory being designed to be substantially in a sleep state except for a selected time interval related to the impact event following an identification of the impact event from the firearm; an amplifier, adapted to amplify the analog signals and transmit the signals to the circuit; a power source to support the circuit supported components; and a communications module for enabling communicating of the digital data to an external data receiver, upon demand.

According to some embodiments the device further includes a threshold voltage comparator, to enable filtering out detected mechanical signals below a selected threshold.

According to some embodiments the device further includes an analog to digital (A2D) converted, to convert the mechanical signals to digital signals.

According to some embodiments the device further includes a real time clock adapted to record the time of a mechanical signal. In yet further embodiments the real time clock is adapted to record the duration of a mechanical signal.

According to some embodiments the device powers down the device substantially immediately, in the case where the signals detected are lower than a selected threshold voltage, or following the recordal and/or processing of shot data.

According to some embodiments the device remains in sleep mode until a force is detected, and during the force sequence the device powers up to enable determination whether the force was a shot.

According to some embodiments the impact sensor is a piezo electric sensor.

According to some embodiments the device further includes an accelerometer configured to qualitatively measure a force received to the impact sensor.

According to some embodiments of the present invention, a system for firearm shot measurement and management, is provided, which includes an impact sensor coupled to a threshold voltage comparator, adapted to identify a shot event from the firearm, such that an impact event is defined as a shot event if a generated analog signal is above a defined energy threshold; an electronic circuit including a battery, microprocessor and memory unit being adapted to be in a substantially sleep state except for a selected time interval related to the defined shot event; a communications sub-system for enabling communicating of data relating to the shot event to an external data receiver upon demand; and an external reader unit adapted to connect to the communications unit, to read the data from said memory.

According to some embodiments, the impact sensor is a piezo electric sensor.

According to some embodiments, the electronic circuit further includes a real time clock, adapted to record the timing of one or more shots.

According to some embodiments, the system includes an accelerometer configured to qualitatively measure a force received to the firearm.

According to some embodiments, the system includes a computing system coupled to the communications sub-system.

According to some embodiments, the computing system is adapted to process data selected from one or more firearm usages, including monitoring firearm usage, calculating firearm usage data, reporting firearm usage data, generating firearm usage patterns, deriving firearm user data and determining firearm performance data.

According to some embodiments, a method for enabling energy efficient firearm shot measurement is provided, which includes one or more of: waking up a shot sensing sub system from a sleep state, by an impact sensor set to react to a generation of a force above a selected threshold, wherein the shot sensing sub system is coupled to a firearm; powering up an electronic circuit to enable transfer of the force through the sensing sub system to a microprocessor, the powering up occurring substantially during the force sequence; translating the force data into digital data representing the force, by said microprocessor; storing the digital data in a memory unit; and powering down the electronic circuit substantially immediately after data storage.

According to some embodiments, the method further includes communicating the digital data from the memory to an external reader unit, when the reader unit causes the electronic circuit to wake up to transmit the data.

According to some embodiments, the method further includes processing the data by a computing system coupled to the external reader unit, the processing being adapted to process data selected from one or more firearm usages, including monitoring firearm usage, calculating firearm usage data, reporting firearm usage data, generating firearm usage patterns, deriving firearm user data and determining firearm performance data.

According to some embodiments, the method further includes measuring the gun shot related force using an accelerometer.

According to some embodiments, the powering up of the electronic circuit is configured to begin substantially immediately following identification of a gun shot related force.

According to some embodiments, the powering down of the electronic circuit is configured to begin within 18-30 mSec following identification of the gun shot related force.

BRIEF DESCRIPTION OF THE DRAWINGS

The principles and operation of the system, apparatus, and method according to the present invention may be better understood with reference to the drawings, and the following description, it being understood that these drawings are given for illustrative purposes only and are not meant to be limiting, wherein.

Figure 1A:
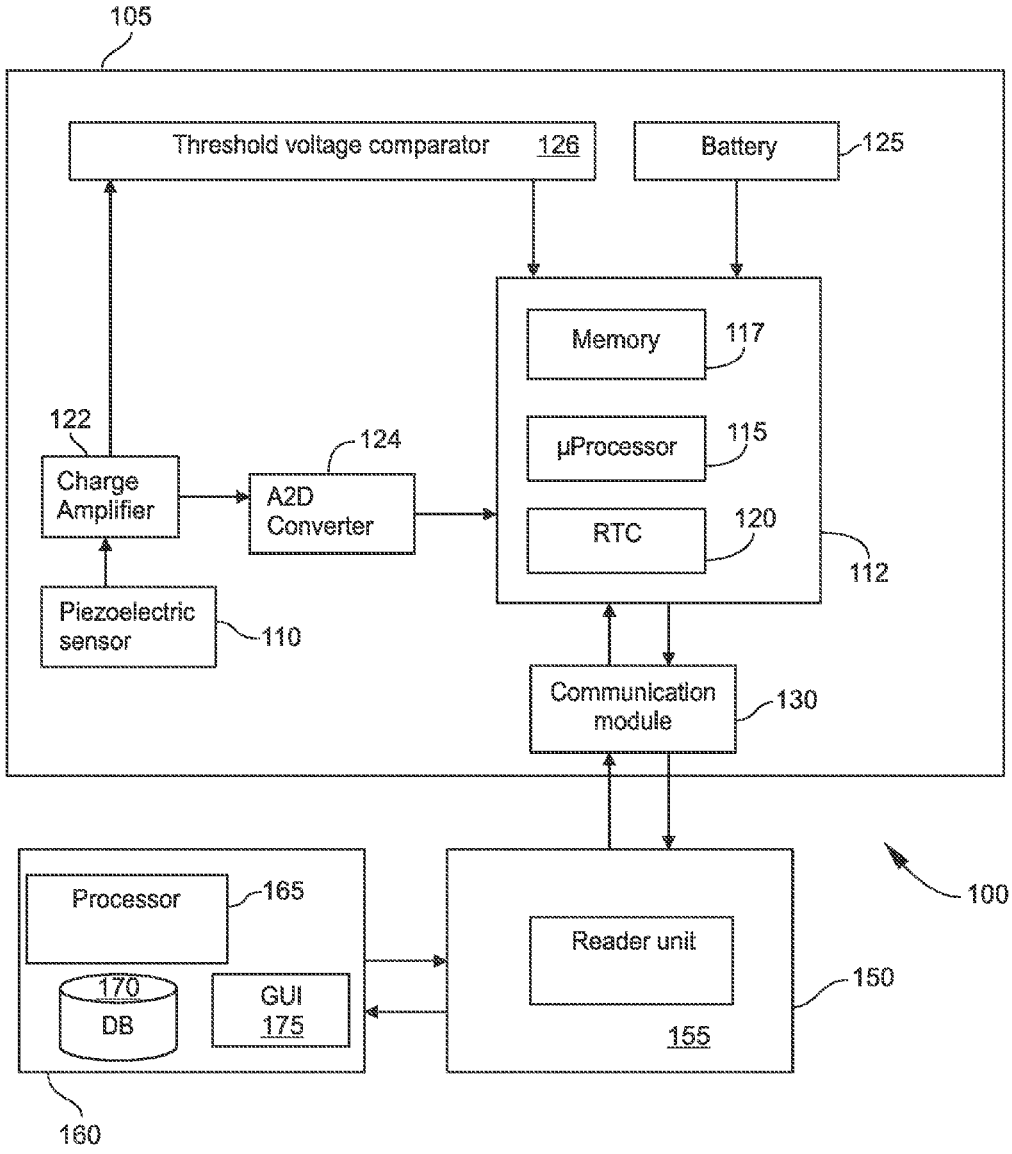
FIGS. 1A and 1B are schematic block diagrams of a system for enabling automated gun shot counting, according to some embodiments.

It will be appreciated that for simplicity and clarity of illustration, elements shown in the drawings have not necessarily been drawn to scale. For example, the dimensions of some of the elements may be exaggerated relative to other elements for clarity. Further, where considered appropriate, reference numerals may be repeated among the drawings to indicate corresponding or analogous elements throughout the serial views.

DETAILED DESCRIPTION OF THE INVENTION

The following description is presented to enable one of ordinary skill in the art to make and use the invention as provided in the context of a particular application and its requirements. Various modifications to the described embodiments will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed. In other instances, well-known methods, procedures, and components have not been described in detail so as not to obscure the present invention.

The phrase "shot counting" as used herein may encompass counting the number of incidences of rounds, shots or events from a variety of firearms, guns, or other shooting weapons, for example, pistols, rifles, machine guns, artillery, rocket launches etc. The phrase "firearms" as used herein may include weapons, especially pistols, rifles or other portable guns, capable of firing a projectile and using an explosive charge as a propellant. The term "shot management" may encompass shot identification, measurement, and usage to help manage firearm control, maintenance, training, and monitoring.

Embodiments of the present invention enable energy efficient automated gun shot counting. Specifically, according to some embodiments, a system is provided that is substantially in sleep mode, yet wakes up for short intervals to count actual shots, thereby enabling substantial energy savings.

Reference is now made to FIG. 1A, which is a schematic block diagram illustration of an energy efficient automated gun shot counting system 100, according to some embodiments. As can be seen in FIG. 1A, the system may include a shot sensing device or sub-system 105, which is coupled to a firearm or weapon being measured. Shot sensing sub-system 105 may be attached, in some embodiments to the external surface of a firearm, for example in the area of the holder or gun butt, or other suitable areas. In other embodiments the Shot sensing sub-system 105 may be located internally. Shot sensing sub-system 105 may include an impact sensor 110, which is coupled to a signal or Charge Amplifier 122, which may amplify relevant impact forces or signals detected from impact sensor 110. Amplifier 122 is further connected to a Threshold Voltage Comparator 126, to help determine when a sensed charge or force is above a selected threshold value, and to an Analog to Digital (A2D) Converter 124. Shot sensing sub-system 105 further includes an Electronic circuit 112 that supports a processor 115, such as a low power micro processor, for processing signals sent from impact sensor 110, an internal or external memory 117, the memory optionally having low power usage requirements. Shot sensing sub-system 105 further includes a power source 125, for example a battery or alternative power source, which powers the sub-system or selected components thereof. In some embodiments power source 125 may provide low power to circuit 112, primarily to keep power amplifier 122 in standby mode, while other system components are substantially in sleep mode, until woken up by an amplifier signal. In further embodiments power supply may continually power Real Time Clock (RTC) 120 (described below) and optionally one or more other system components. In further embodiments power supply may continually power Communications module (described below) and optionally one or more other system components. Shot sensing sub-system 105 may be encased by a casing to protect system components.

In some embodiments, for example, power source 125 may maintain circuit 112 in a substantially sleeping mode, by having only the amplifier 122 awake to monitor impact sensor activity. When impact sensor 110 reacts to a force, amplifier 122 may detect the force and output a signal that effectively wakes up circuit 112 and the circuit components, for a minimal defined interval, as is described below. In this way, energy consumption during "sleep" time is negligible, and when the system is powered up or woken up following a sufficiently substantial force, the system wakes up only briefly to execute impact measurement, to be used in determining shot counting. Similarly, power source may be configured to power down the circuit and/or circuit components, or or put them to sleep, following an event, in accordance with per-determined values or levels, so as to enable energy saving by powering down substantially immediately after completing the necessary data storing or processing. In other case the system may be powered down or put to sleep before data storage and processing, for example, where the force detected is below a selected threshold value. According to some embodiments the system remains in sleep mode until a force is detected, and during the force sequence the device powers up to enable determination whether the force was a shot.

According to some embodiments, impact sensor 110 may include sensor(s) of various levels of sensitivity designed to identify and/or measure forces above a selected threshold, and filter out forces that are below a minimal threshold, as defined by the sensitivity level selected. For example, if a 15G switch is used, only incidences with impulses or forces greater than 15G will register on the impact sensor, and these incidences alone will be transmitted to processor 115, to wake up processor 115. Impact sensor 110 may be constructed from mechanical parts and/or from Piezoelectric sensing elements. For example, a Piezoelectric sensor may be used to enable transformation of energy from a mechanical input into an electrical output. More specifically, when a pressure is applied to such piezoelectric material, it may cause a mechanical deformation and a displacement of charges, which are highly proportional to the applied pressure. In another example, there may be multiple Piezoelectric sensors, for example, one for waking up the system and one for measurement, however in some examples a single Piezoelectric sensor may be used for both measurement and waking up of the system. In this example, the piezoelectric sensor may be connected to an amplifier, such that the connection to the amplifier can receive constant updates on measurements of forces or impacts, as well as to an A2D converter. In other embodiments, other mechanical impact sensor(s), Piezoelectric sensing elements, or any other suitable passive components activated by impact may be used.

Shot sensing sub-system 105 may further include a Real Time Clock (RTC) 120, such as a RTC Crystal, for providing accurate measurements in time for detected incidences or events (i.e. adapted to record the timing of one or more shots). RTC 120 may include an independent power source or may use power from power source 125. In some embodiments there may be no RTC.

Shot sensing sub-system 105 further includes a communications module 130 or sub-system, for example a wireless communications module, such as an IR transceiver, for wirelessly transmitting system data to external components or systems. Communications module 130 may transmit data using IR, radio transmissions, RFID, Zigbee or other energy saving data communications protocols. In some embodiments the sub-system can wake up regularly to receive communications from outside, while in other embodiments the sub-system may be woken up from outside using IR or other external communications wake-up techniques. In general, communications module 130 may be configured to be in sleep mode until woken up by an external reader unit (described below) or by circuit 112.

System 100 may further include communications module or sub-system 150 for receiving the data from the sensor sub-system 105, or more specifically from the communications module 130. Communications sub-system 150 includes a Reader unit 155 for receiving data from communications module 130. Communications module 150 may transmit/receive data using IR, radio transmissions, RFID, Zigbee or other energy saving data communications protocols For example, in the case where an IR transceiver is used to transmit data from the sensor sub-system, a parallel IR transceiver will be used in the reader sub-system to receive the data transmitted by IR transceiver 130. In this way system usage data may be rapidly and automatically transmitted from multiple weapons to the reader sub-system 150. Communications sub-system 150 may further include a hardware interface for connecting the reader unit 155 to an external or integrated computing system 160. For example, a USB interface or wireless interface may be used to enable the Communications sub-system 150 to be directly connected to a personal computer, server etc., hereinafter referred to as a computing system 160, via the hardware interface. In general, since sensor sub system 105 may maintain communications module 130 substantially in sleep mode, Communications sub-system 150 may function as system wake up element to wake up one or more of the shot sensing sub-system components to activate communications module 130 to transmit data from acquired from memory 117 substantially upon demand.

In one example, communications module 130 may be configured to be continually in sleep mode until woken up by a signal from amplifier 122, processor 115, real time clock 120, and/or from a signal from reader unit 155 or Communications sub-system 150. In some embodiments Communications module 130 may be powered independently. In some embodiments communications module 130 may be configured to be in standby mode (i.e. wake up mode) at fixed, random or other selected intervals. For example, when the sensor sub-system 105 is placed within a suitable communication range with the reader unit 155, the reader unit 155 may transmit a signal or light pulse etc. to the sensor sub-system 105. When the signal or light pulse from the reader unit 155 is recognized, the shot sensing sub-system 105 may switch the communications module 130 to work mode or wake up mode, to enable transmission of data from memory 117 to the reader unit 155. In one example, the light energy from the reader unit received by a photodiode of the communications unit may provide sufficient voltage potential to switch the IR communication module to work mode. In other embodiments the waking up of the communications module 130 may cause the sensor sub-system 105 to be woken up. Communications module 130 may include its own power source; however in some embodiments communications module 130 is powered by power source 125. Communications sub-system 150 may include additional components, such as memory, processor, communications ports, power supply etc.

Computing system 160 may include a data processor 165 and a data base 170 for processing and holding system usage data. In some embodiments the database may contain weapon identification data such as a code for each weapon, so that weapon data can be associated with a unique code, to identity the relevant data associated with each weapon used. The computing system may further include a GUI 175 for presenting system usage data to a user. In other embodiments other hardware interfaces may be used to connect via cable or wirelessly to a computing system. Of course, other structures and dimensions may be used.

According to some embodiments the system components may "wake up" or be "powered up" each time an impact is registered by the impact sensor, and may go back "to sleep" or be "powered down" substantially immediately following the impact and the recoding thereof in memory. In this way significant energy savings may be achieved, by powering the system for specific events only, and for significantly limited system awake intervals, in relation to the actual impacts only. In some embodiments the data stored in the memory may be transmitted whenever the communications module is operating. In other embodiments the data stored in the memory may be stored for a selected period or interval of time until the communications module is woken up or otherwise instructed to operate. As described above, the system's power source and one or more other components are typically in sleep mode, thereby extending significantly the time that the system can continue operate as a firearm shot counting system, based on the current power source.

Figure 1B:
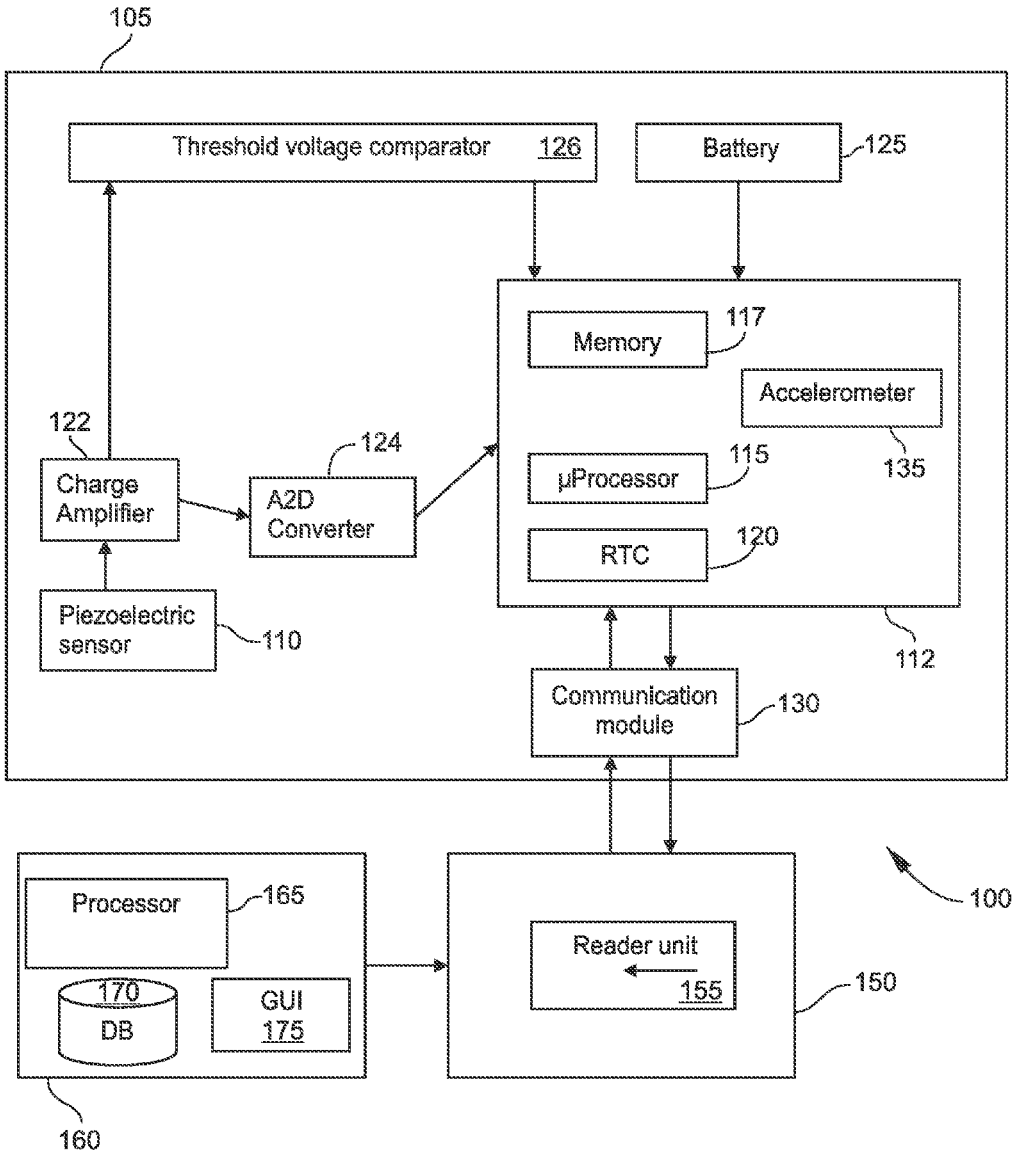

Reference is now made to FIG. 1B, which illustrates a similar system as described in FIG. 1A, with the addition of an Accelerometer 135, coupled to circuit 112. Shot sensing sub-system 105 may include accelerometer 135, for example ADXL345 or other suitable measurement devices, being communicatively coupled to processor 115 and/or real time clock 120. Accelerometer 135 may be used for measuring qualitative and/or quantitative aspects of forces or impulses generated by the weapon. Accelerometer 135 is in general powered by power source 125; however in some embodiments accelerometer 135 may include its own power source. In some embodiments accelerometer 135 is configured to be continually in sleep mode until woken up by a signal from processor 115 or from amplifier 122.

Accelerometer may be used, for example, to measure a variety of impulses or forces and to determine with significant accuracy whether the impulses measured represent a shot from the weapon, a loading of the weapon, an entry of a magazine, a dropping or placing of the weapon on a hard surface etc. For example, if a particular weapon is shot, the direct impulse from the shot may be registered in around 2 milliseconds, while the additional impulses such as the return of the barrel, reloading of a bullet etc., should be registered within approximately 8-20 milliseconds, or 6-18 milliseconds. The accelerometer may be able therefore to measure a series of impulses such that if the secondary impulse is recorded in the expected range of time, this is an indication that the initial impulse was a shot of the weapon. On the other hand, if the second impulse came approximately 1 second after the first, this may be an indication that the initial impulse was not a gun shot, but rather a drop or other action with the firearm. In some embodiments the mechanical impact sensor can record the second or follow up pulses, to enable confirmation of a gun shot by the impact sensor, according to the time or length of the impact pulse. This may be particularly relevant for weapons with long barrels.

According to some embodiments the system components may "wake up" each time an impact is registered by the impact sensor, and may go back "to sleep" following a selected interval after the initial impact is measured. For example, if the typical shot impulse is followed by a secondary impulse within 25 milliseconds, the system may be configured to stay awake for 30 milliseconds following an impulse registered, to cover the time range in which a verification or secondary signal should. At for example 30 Milliseconds, the system may be shut down or put to sleep. In another example, if the typical shot impulse is followed by a secondary impulse within 25 milliseconds, the system may be configured to stay awake for 20 milliseconds following an impulse registered, and to wake up and measure each substantial force signal for a minimum time interval that is less that the expected interval required before an additional shot is fired. In the above ways significant energy savings may be achieved, by powering the system for specific limited time intervals when operationally relevant only. Of course, other time intervals and threshold values may be used, in accordance with the gun type, barrel length, ammunition type etc.

Figure 2:
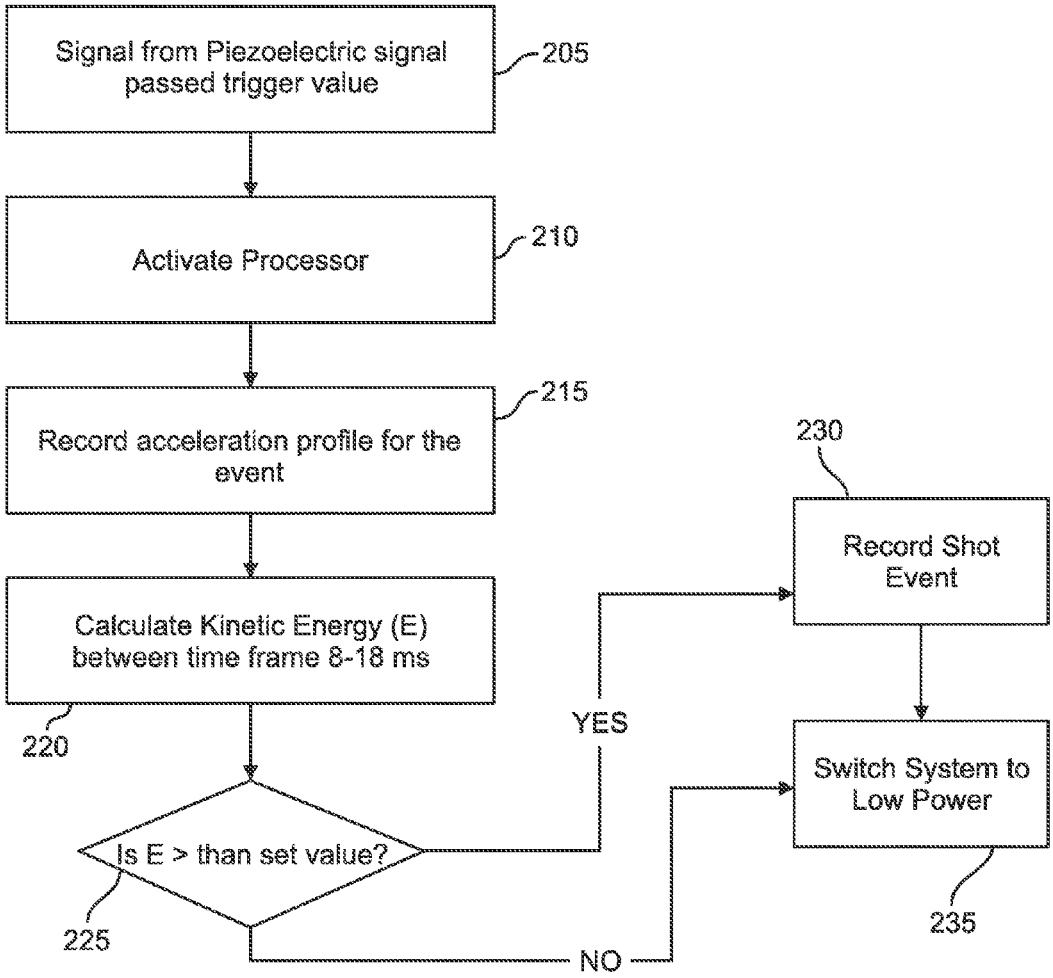
FIG. 2 is a flowchart illustrating an example of a process of automated gun shot counting, according to some embodiments.

FIG. 2 schematically illustrates a series of operations or processes that may be implemented to enable automated energy efficient firearm shot counting, according to some embodiments. Initially the sensor sub-system is coupled to a gun or firearm, with selected electronic components configured to be in sleep mode. In some embodiments the Amplifier may not be in sleep mode so as to enable signal amplification at all times. In some embodiments the RTC may not be in sleep mode so as to be able to maintain its timing. In still further embodiments the communications unit may not be in sleep mode, and may be configured to switch to standby mode at selected intervals. At block 205, when the firearm is fired, loaded or otherwise handled, the mechanical impact sensor, which is continually active or awake, measures the force of any movements, shocks, vibrations or other incidents. A detected force or impulse is subsequently amplified by the amplifier, and verified by the threshold voltage comparator, to determine whether the detected force is above the minimal configured force limit. The signal, if above the threshold value, is subsequently utilized to wake up the circuit or selected components thereof. The force or impulse that was registered by the impact sensor is additionally converted by a A2D converted into a digital signal, prior to being handled by the circuit processor. For example, the circuit supported components within the sensor sub-system may be powered while the impact sensor is compressed at a sufficient force level. This compression of the impact sensor (e.g. via a spring) may thereby generate circuitry activity and enable the various system components to be powered up by the power source and to be substantially instantaneously woken up into operation mode. For example, at block 210, the converted Digital signal from the impact sensor may activate the processor. In some embodiments the processor may reset the timer.

At block 215, the system, which is already in wake up mode, may wait for an additional signal or signals from impact sensor. In other embodiments such additional signals may be generated as trigger values from an accelerometer. In one example, at block 220, the system may be configured to ignore any additional signals received during the first 6 MSEC, which would be interpreted as not being connected to a shot. At block 225, when a second signal is detected, the processor must confirm whether the second signal has been received, for example, between 6 and 30 MSEC following the first signal. In the case where this is true (Yes), at block 230, the signals received are considered shots and are recorded. In the case where this condition is false (No), the signals received are not considered shots. At block 235, in both cases, following the interval of, for example, 30 MSEC, the system is switched to low power standby mode, or sleep mode. At block 225 the processor may request and collect data from the RTC as to what time the incident occurred. In other embodiments there may be no RTC to request time stamp data from, or the RTC may be coupled to the Accelerator. The signal data and/or the processed data maybe stored in the memory, optionally for multiple incidents. Of course, other threshold values may be used, as may other operation flow algorithms, in accordance with system definitions, gun types, ammunitions types, gun usages etc.

Following one or more shot sensing operations as described above, a suitable communications channel is setup between the sensor sub-system communications unit and the reader unit in the communications sub-system. When such a channel has been effectively setup, the processor commands the sensor sub-system to transmit data to the reader unit in the communications sub-system. The communications sub-system may subsequently be coupled, via cable or wirelessly, to an integrated or external computing system, such that the transmitted data can be transferred to the computing system. The computing system may process, manipulate, aggregate, and present the data etc. to a user, for example, to provide shooting data for a weapon. Such shooting data may include, for example, the number of shots fired, the date fired, and the precise timing of the shots fired.

In some embodiments, the sensor sub-system communications module may transmit data at selected intervals, so as to avoid constant transmissions, yet to facilitate communication channel creation when a paired communications sub-system or reader unit, is coupled to the sensor sub-system communications module. Any combination of the above steps may be implemented. Further, other steps or series of steps may be used.

According to some embodiments, wherein an accelerometer communicatively coupled to the processor is included in the system, the force signal or signals are measured up by the accelerometer, which may help determine qualitative and/or quantitative data about the signal received. As described above, the accelerator may measure a series of impulses or forces that are typically associated with a firearm shot, and use the data received to determine with high accuracy if a shot was fired or whether the impact registered may likely have been caused by another factor besides a shot from the weapon. For example, a shot from a selected handgun and ammunition set should be accompanied by at least a second impulse within 30 milliseconds, so if such a secondary shot is not registered the first impulse may be assumed to have not been a shot. In some embodiments the accelerometer is not active during the first "pulse" of the shooting sequence, and gets activated to handle the subsequent pulses only. The accelerator may transmits the measured signal(s) data and/or processing data to the processor.

In some embodiments, where a Piezoelectric sensor is used, then a charge or electric force is generated that is transmitted to the processor/power source and helps wake up the system components. In some embodiments, where both mechanical and Piezoelectric impact sensors are used, these may be used in parallel or in alternative configurations to handle impact or impulse sensing of multiple events or incidences.

According to some embodiments, the various system components are maintained in a sleeping or resting state until a substantial impact (first signal above a selected threshold value) is registered by the impact sensor. When a substantial incident is noted or recorded, the system assumes a shooting incident has occurred, in which case the circuit will be closed and the system woken up. When a second signal (follow up force following the first shot) is noted by the impact sensor, the data will be transmitted through the system components, which are already in wake up mode, such that the second signal can be measured, for example by the accelerator, thereby verifying that the first signal was a shot. All incidents below the selected impact sensitivity level will be substantially unregistered by the impact sensor and thereby ignored by the system components.

Figure 3:
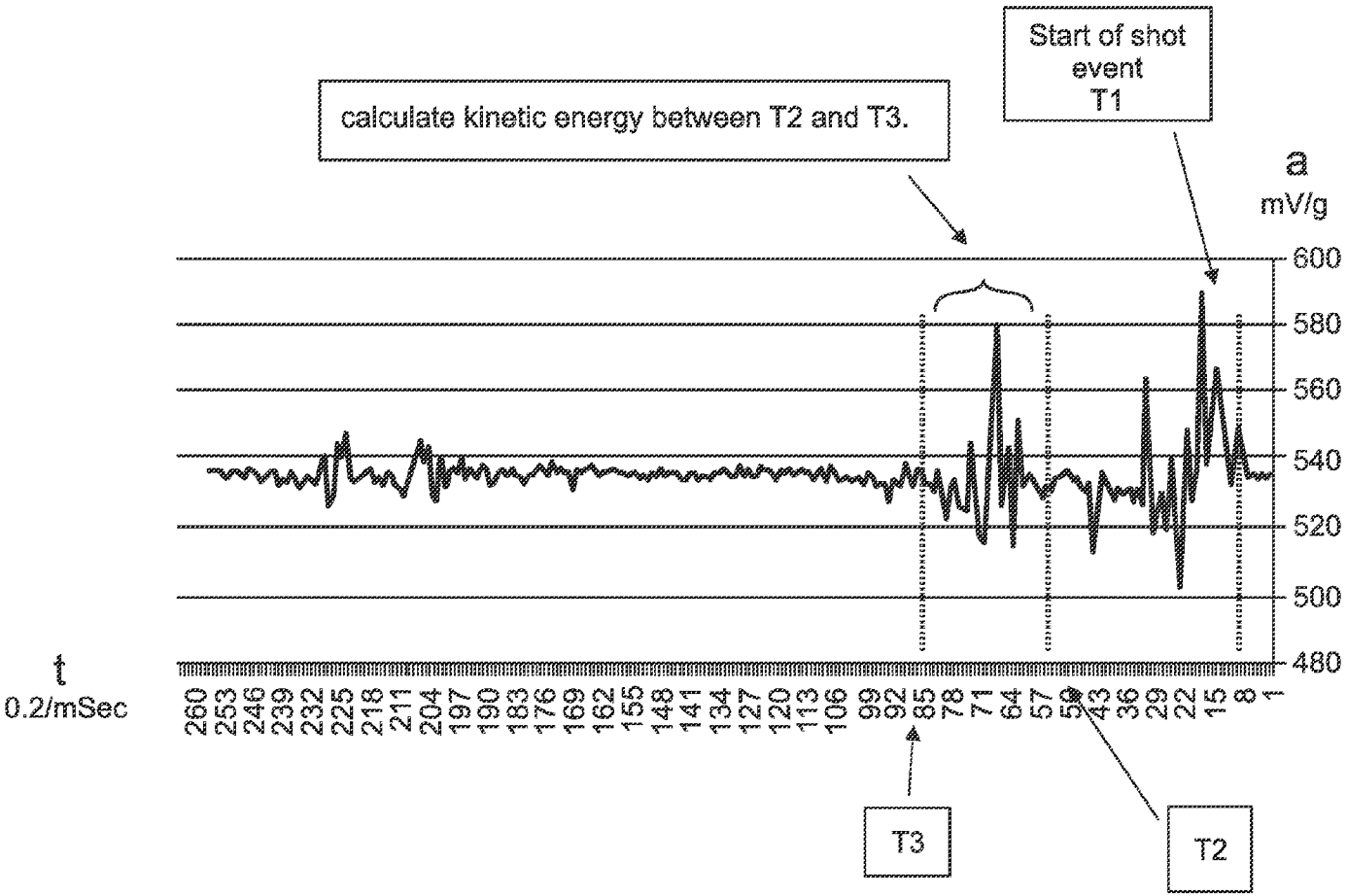
FIG. 3 is a chart illustrating an example of a shooting measurement session, according to some embodiments.

Reference is now made to FIG. 3, which is a graph illustrating an example of data gathered from a weapon during a typical shot sequence, using the system. As can be seen in FIG. 3, a shot detection sequence may include one or more of the following stages: At t=1-8, there is no force event, and the system is in sleep mode. At T1 (t=8) a trigger, force or pulse, which surpasses a force threshold, is detected from the impulse sensor, and thereby wakes up the system. Optionally a time counter is activated (or the time of the pulse is stored as "value A"). As can be understood from the above, the powering up of the electronic circuit may be configured to begin substantially immediately following the occurrence of a gun shot force, such that the sensing system may be asleep during an actual shot event, and may be woken up during the shot event to start substantially immediate shot measurement. Between T1 and T2 (t=8-55), the system is in awake mode and monitors or checks for additional forces detected. In somer examples the system may take around 1 mSec after detection to start full operation, which may, for example, take place around t=22. In the case where substantial additional impulse(s) or signal(s) are detected from the wake up time within approximately 6-10 mSec, then the previously detected signals may be ignored, and the system powered down into sleep mode, as the additional signals detected indicate forces other than a shot force. For example, a typical shot may have a signature, pattern or known system of events that follow such a force. Forces sensed too early or late or that do not otherwise fit the shot signature may be assumed to be forces other than shots. In the case where a substantial additional impulse or force from the impact sensor is not detected from the period of, for example, 6 mSec to 10 mSec, then the first impulse is counted as a potential shot. In the period T2-T3, between t=55-85, the system further monitors for impulses. If a substantial force (above a defined minimum value) is detected during this period, then the force may be assumed to have been a shot, and from around t=85, the shot data may be stored in the memory. In some examples the "value A" is decreased from the time of the last impulse. From T3 (from t=85), in the case where no additional pulse is detected until, for example, 30 mSec or approximately t=120, the system may assume that no shot was fired, in which case the first pulse may be ignored, the counter may be reset, and the system may be powered down to sleep mode. After data has been entered into memory, the data may be processed. Of course, the specific intervals and times of stages/actions described above and in FIG. 3 are approximate and may be different. Furthermore, the numbers described typically depend on the length of gun, type of ammunition, type of gun etc., therefore various other data sets based on the principles described may be used.

The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

What is claimed is:

1. A low energy firearm shot measurement device, comprising:

i. an impact sensor adapted to detect a substantial impact event from the firearm, and to generate an analog signal representing said impact event;

ii. an electronic circuit supporting a microprocessor to enable processing of digital data representing said analog signal, said electronic circuit also supporting a memory unit to store said digital data, said microprocessor and said memory being designed to be substantially in a sleep state except for a selected time interval related to said impact event following an identification of said impact event from said firearm;

iii. an amplifier, adapted to amplify said analog signals and transmit said signals to said circuit;

iv. a power source to support said circuit supported components; and v. a communications module for enabling communicating of said digital data to an external data receiver upon demand.

2. The device of claim 1, wherein the device is powered up substantially during an impact event, in the case where said analog signals are above said selected threshold value.

3. The device of claim 1, further comprising an analog to digital (A2D) converted, to convert said analog signals to digital signals.

4. The device of claim 1, further comprising a real time clock adapted to record the timing of or more impact events.

5. The device of claim 1, wherein said impact sensor is a piezo electric sensor.

6. The device of claim 1, further comprising an accelerometer configured to qualitatively measure an acceleration force received to said impact sensor.

7. The device of claim 1, further comprising a threshold voltage comparator, to enable filtering out detected analog signals below said selected threshold value.

8. The device of claim 7, wherein the device remains in said sleep state in the case where said analog signals are lower than said selected threshold value.

9. A system for firearm shot measurement and management, comprising:

i. an impact sensor coupled to a threshold voltage comparator, adapted to identify a shot event from said firearm, such that an impact event is defined as a shot event if a generated analog signal is above a defined energy threshold;

iii. an electronic circuit including a battery, microprocessor and memory unit being adapted to be in a substantially sleep state except for a selected time interval related to said defined shot event;

ii. a communications sub-system for enabling communicating of data relating to said shot event to an external data receiver upon demand; and iv. an external reader unit adapted to connect to said communications unit, to read said data from said memory.

10. The system of claim 9, wherein said impact sensor is a piezo electric sensor.

11. The system of claim 9, wherein said electronic circuit further includes a real time clock.

12. The system of claim 9, further comprising an accelerometer configured to qualitatively measure acceleration acting on said firearm.

13. The system of claim 9, comprising a computing system coupled to said communications sub-system, wherein said computing system is adapted to process data selected from one or more firearm usages, including monitoring firearm usage, calculating firearm usage data, reporting firearm usage data, generating firearm usage patterns, deriving firearm user data and determining firearm performance data.

14. A method for enabling energy efficient firearm shot measurement, comprising:

i. waking up a shot sensing sub system from a sleep state, by an impact sensor set to react to a generation of an impact event above a selected threshold value, wherein said shot sensing sub system is coupled to a firearm;

ii. powering up an electronic circuit to enable transfer of said force through the sensing sub system to a microprocessor, said powering up occurring substantially during the impact sequence;

iii. translating analog data representing said impact sequence into digital data representing said impact event, by an Analog To Digital converter;

iv. storing said digital data in a memory unit; and v. powering down said electronic circuit substantially immediately after data storage.

15. The method of claim 14, further comprising communicating said digital data from said memory to an external reader unit, when said reader unit causes said electronic circuit to wake up to transmit said data.

16. The method of claim 15, further comprising processing said data by a computing system coupled to said external reader unit, said processing being adapted to process data selected from one or more firearm usages, including monitoring firearm usage, calculating firearm usage data, reporting firearm usage data, generating firearm usage patterns, deriving firearm user data and determining firearm performance data.

17. The method of claim 15, further comprising measuring said impact event using an accelerometer.

18. The method of claim 15, wherein said powering up of said electronic circuit is configured to begin substantially immediately following occurrence of a gun shot, such that said sensing system may be asleep during an actual shot event, and may be woken up during said shot event to start shot measurement.

19. The method of claim 15, wherein said powering down of said electronic circuit is configured to begin within 18-30 mSec following identification of said impact event.

20. The method of claim 15, comprising identifying specific energy value(s) in a specific time interval from after wake up time, to identify if there was a shot.

* * * * *